US010574371B2

(12) United States Patent
Keith

(10) Patent No.: US 10,574,371 B2
(45) Date of Patent: Feb. 25, 2020

(54) AUDIO PROCESSOR APPARATUS, METHODS AND COMPUTER PROGRAM PRODUCTS USING INTEGRATED DIVERSITY DELAY ERROR COMPENSATION

(71) Applicant: Wheatstone Corporation, New Bern, NC (US)

(72) Inventor: Jeffrey Allan Keith, New Bern, NC (US)

(73) Assignee: WHEATSTONE CORPORATION, New Bern, NC (US)

( * ) Notice: Subject to any disclaimer, the term of this patent is extended or adjusted under 35 U.S.C. 154(b) by 0 days.

(21) Appl. No.: 15/790,785

(22) Filed: Oct. 23, 2017

(65) Prior Publication Data

US 2019/0123841 A1 Apr. 25, 2019

(51) Int. Cl.

*H04H 20/18* (2008.01)
*H04H 20/48* (2008.01)
*H04H 20/72* (2008.01)

(52) U.S. Cl.

CPC ..... *H04H 20/18* (2013.01); *H04H 20/48* (2013.01); *H04H 20/72* (2013.01); *H04H 2201/183* (2013.01)

(58) Field of Classification Search

CPC ..... H04H 20/28; H04H 2201/18; H04H 2201/183; H04H 20/48; H04H 20/72

See application file for complete search history.

(56) References Cited

U.S. PATENT DOCUMENTS 6,590,944 B1 * 7/2003 Kroeger ..... H04H 20/30 375/340
2009/0271185 A1 * 10/2009 Smithers ..... H03G 7/007 704/225

(Continued)

OTHER PUBLICATIONS

"Belar Precision Digital FM HD Stereo Monitor/Analyzer, FMHD-1" Belar Electronics Laboratory, Inc., http://www/belar.com, Admitted Prior Art, 2 pages.

(Continued)

*Primary Examiner* — Raymond S Dean
(74) *Attorney, Agent, or Firm* — Ward and Smith, P.A.; Ryan K. Simmons

(57) ABSTRACT

An audio processor includes a detector configured to determine a correlation of first and second data corresponding to an analog FM component and an HD FM component, respectively, of a broadcast RF signal. A signal processor is configured to receive an input audio signal, to generate an analog FM audio signal and an HD FM audio signal therefrom and to control a relative timing of the analog FM audio signal and the HD FM audio signal based on the determined correlation. The signal processor may include a multiband limiter configured to generate a multiband limited audio signal responsive to the input audio signal, an HD FM audio processor configured to generate the HD FM audio signal responsive to the multiband limited audio signal, and an analog FM audio processor configured to generate the analog FM audio signal responsive to the multiband limited audio signal and to delay the analog FM audio signal responsive to the timing control signal.

21 Claims, 7 Drawing Sheets

(56) References Cited

U.S. PATENT DOCUMENTS

| | | | | |
|---|---|---|---|---|
| 2013/0279700 | A1* | 10/2013 | Whitecar | H04H 60/12 381/3 |
| 2017/0302432 | A1* | 10/2017 | Kroeger | H04H 20/30 |

OTHER PUBLICATIONS

"Justin 808 FM/HD1 Alignment Processor," 1Inovonics Broadcast, www.inovonicsbroadcast.com, Aug. 2015, 4 pages.
"M4 Timelock™ AM/FM HD Receiver, DaySequerra," www.daysequerra.com, Admitted Prior Art, 3 pages.
"The Need for Automatic Alignment of HD Radio Diversity Delay", Radio Magazine, http://www.radiomagonline,com/deep-dig/0005/the-need-for-automatic-alignment-of-hd-radio-diversity-delay; Printed from the Internet on Oct. 20, 2017, Admitted Prior Art, 12 pages.

* cited by examiner

AUDIO PROCESSOR APPARATUS, METHODS AND COMPUTER PROGRAM PRODUCTS USING INTEGRATED DIVERSITY DELAY ERROR COMPENSATION

BACKGROUND

The inventive subject matter relates to HD FM apparatus and methods of operating the same and, more particularly, to diversity delay error compensation of and for FM HD audio processors.

HD Radio™ is an in-band on-channel digital radio technology in which a broadcaster transmits audio and data using a digital signal transmitted in the same spectrum as the broadcaster's standard analog FM signal. Stations typically simulcast digital and analog audio signals, which are received by receivers that can "blend" audio in the received signals to produce an audio output.

FIG. 1 illustrates a conventional HD radio transmission system. Studio or other input audio is provided to an audio processor 10, which typically provides processed analog FM audio and HD FM audio for transmission by a transmitter 30 via an IP network 20. The audio processor 10 may be designed to limit overmodulation, compensate for non-linearities in the transmitter 30 and adjust overall loudness to a desirable level.

There are significant and variable latencies in this arrangement, including latencies in processing by the audio processor 10. There may also be significant latencies in conveying the HD audio content to the transmitter 30, which may be remote with respect to the audio processor 10 and subject to congestion, retransmission and other effects arising from the use of the IP network 20 to convey the audio content. These latencies often result in the transmitted HD FM signal lagging the transmitted analog FM signal by a significant amount of time, e.g., 8-10 seconds. Accordingly, FM stations typically delay their analog FM signals so that FM/HD receivers can nearly seamlessly switch between the two signals under low signal strength and/or high interference conditions. In a typical FM/HD station's signal chain, transmission of the FM analog signal through the audio processor is usually delayed by several seconds, with the specific amount being dependent upon the station's chosen FM/HD hardware and the studio-to-transmitter audio program transport mechanism(s) which may be in use.

In the early days of HD technology, when stations typically installed their FM/HD on-air audio processors at the transmitter site, typically the only signal transmitted between the studio and transmitter was a single stereo program channel. In this arrangement, the separately processed FM and HD program audio came directly from the on-air processor's outputs, was fed directly into the FM/HD transmission equipment, and once diversity delay was set to the required amount, it typically needed little or no subsequent readjustment. Years later, the introduction of lower cost, high bandwidth, bidirectional IP-based microwave systems allowed stations to relocate the on-air audio processor to the studio and send the separate analog FM and HD FM audio signals as separate data packet streams over an IP based link to the transmitter site miles away.

The problem with IP links, however, is that the timing relationship between the analog FM and HD FM audio packets is generally indeterminate. By relocating the audio processing to the studio, the diversity delay can vary widely and can drift in and out of tolerance due to the IP-based link.

A few techniques have been developed to address this latency problem. Several years ago, manufacturers of FM modulation monitors began to incorporate the ability to perform diversity delay error measurements in their products. Station engineers typically manually adjusted diversity delay to reduce timing errors, but such modified modulation monitors do provide a more reliable scheme for measuring timing errors than the old way of "tuning it by ear." These modified FM modulation monitors soon included the capability to communicate with audio processors, such that the modulation monitor could control the audio processor's diversity delay in closed-loop fashion, such as over an IP network. FIG. 2 illustrates such an arrangement wherein an FM/HD modulation monitor 40 provides a diversity delay correction command to an audio processor 10, which responsively adjusts a delay the audio processor 10 applies to an analog FM audio signal transmitted to the transmitter 30. Examples of such modulation monitors include the FMHD-1 FM HD Stereo Monitor/Analyzer produced by Belar Electronics Laboratory, Inc., and the Series 2 M4 TimeLock™ Broadcast Receiver produced by DaySequerra Corporation.

Another technique for compensation for dealing with diversity delay errors is illustrated in FIG. 3. In this arrangement, a delay processor 50 is connected at the output of the audio processor 10. The delay processor 50 measures a time discrepancy between analog FM and HD FM signals transmitted by the transmitter 30, and delays the analog FM output of the audio processor 30 accordingly. An example of such a delay processor is the Justin 808 HD Radio™ Delay produced by Innovonics, Inc.

Potential disadvantages of both of the aforementioned arrangements include the additional cost of the FM/HD modulation monitor or delay processor (typically several thousands of dollars), and an additional potential point of failure in the station's audio chain. In addition, a delay processor such as that shown in FIG. 3 may be limited to correcting only a limited amount of diversity delay error (e.g., one second). Accordingly, there is an ongoing need for improved techniques for diversity delay error compensation.

SUMMARY

Some embodiments of the inventive subject matter provide an audio processor including a detector configured to determine a correlation of first and second data corresponding to an analog FM component and an HD FM component, respectively, of a broadcast RF signal. The apparatus further includes a signal processor configured to receive an input audio signal and configured to generate an analog FM audio signal and an HD FM audio signal therefrom and to control a relative timing of the analog FM audio signal and the HD FM audio signal based on the determined correlation. In some embodiments, the detector may be configured to generate a timing control signal responsive to the determined correlation, and the signal processor may be configured to delay the analog FM audio signal with respect to the HD FM audio signal responsive to the timing control signal.

According to some embodiments, the signal processor may include a multiband limiter configured to generate a multiband limited audio signal responsive to the input audio signal, an HD FM audio processor configured to generate the HD FM audio signal responsive to the multiband limited audio signal, and an analog FM audio processor configured to generate the analog FM audio signal responsive to the multiband limited audio signal and to delay the analog FM audio signal responsive to the timing control signal. The signal processor may be configured to add a beacon to the multiband limited signal and the detector may be configured to detect first and second beacon components corresponding to the added beacon in the first and second data, respectively, and to generate the timing control signal responsive to the detected beacon components.

In some embodiments, the detector may be configured to generate a cross-correlation of the first and second data and to generate the timing control signal responsive to the generated cross-correlation. In further embodiments, the detector may be configured to generate correlations of the first and second data with known data generated by the signal processor and to generate the timing control signal from the generated correlations.

According to some embodiments of the inventive subject matter, an apparatus includes a detector configured to generate a timing control signal from first and second audio data streams corresponding to respective broadcast analog FM audio and broadcast HD FM audio components of an RF signal. The apparatus further includes a signal processor including a multiband limiter configured to generate a multiband limited audio signal responsive to an input audio signal, an HD FM audio signal processor configured to generate an HD FM audio signal responsive to the multiband limited audio signal, and an analog FM audio signal processor configured to generate an analog FM audio signal responsive to the multiband limited audio signal and to delay the analog FM audio signal responsive to the timing control signal. The signal processor may further include a beacon signal insertion unit configured to add a beacon to the multiband limited audio signal. The detector may be configured to detect beacon components corresponding to the beacon in the first and second audio data streams and to generate the timing control signal responsive to the detected beacon components.

In some embodiments, the detector may be configured to generate a cross-correlation of the first and second audio data streams and to generate the timing control signal responsive to the generated cross-correlation. In some embodiments, the detector may be configured to generate correlations of the first and second audio data streams with known data generated by the signal processor and to generate the timing control signal from the generated correlations.

Additional embodiments provide methods including, at an audio processor, determining a correlation of first and second data corresponding to an analog FM component and an HD FM component, respectively, of a broadcast RF signal. The audio processor generates an analog FM audio signal and an HD FM audio signal from an audio input signal and varies a relative timing of the analog FM audio signal and the HD FM audio signal based on the determined correlation. Operating the audio processor may include generating a multiband limited audio signal responsive to the input audio signal, generating an HD FM audio signal responsive to the multiband limited audio signal, generating an analog FM audio signal responsive to the multiband limited audio signal, generating a timing control signal from first and second audio data streams corresponding to respective ones of the analog FM audio and HD FM audio components of the broadcast RF signal, and delaying the analog FM audio signal responsive to the timing control signal. The methods may further include adding a beacon to the multiband limited audio signal. Generating the timing control signal may include detecting beacon components corresponding to the beacon in the first and second audio data streams and generating the timing control signal responsive to the detected beacon components.

DETAILED DESCRIPTION

Figure 1:
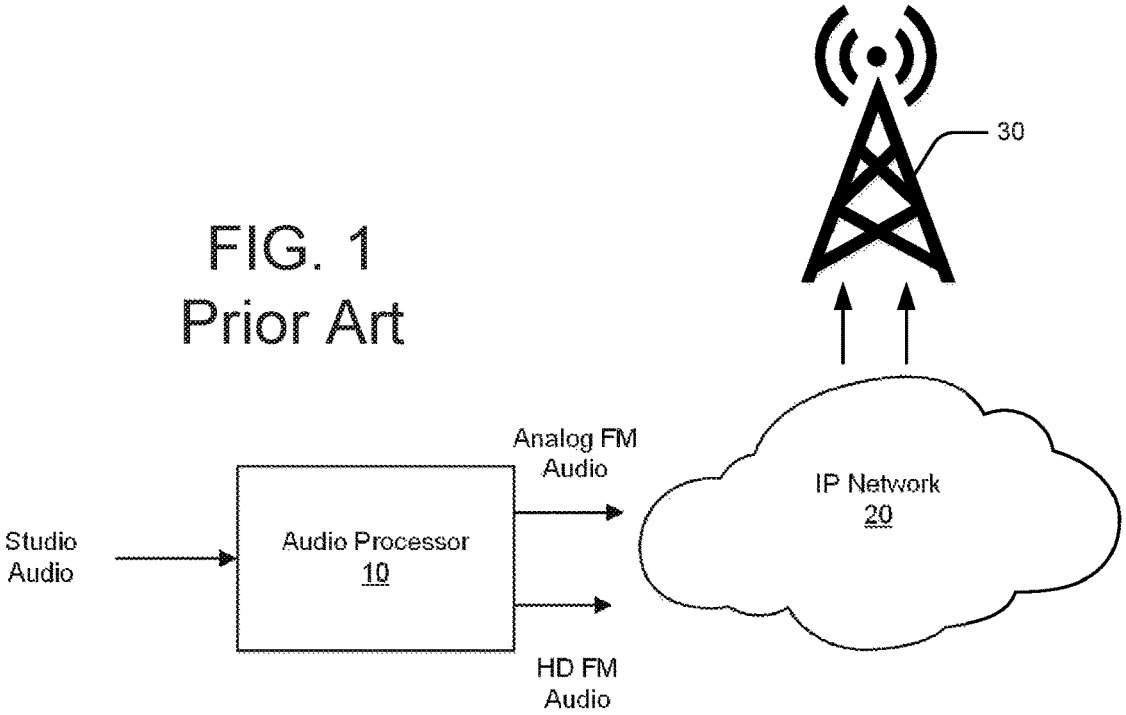
FIG. 1 Prior Art
FIG. 1 is a schematic diagram illustrating a conventional HD FM broadcast system architecture.
Figure 2:
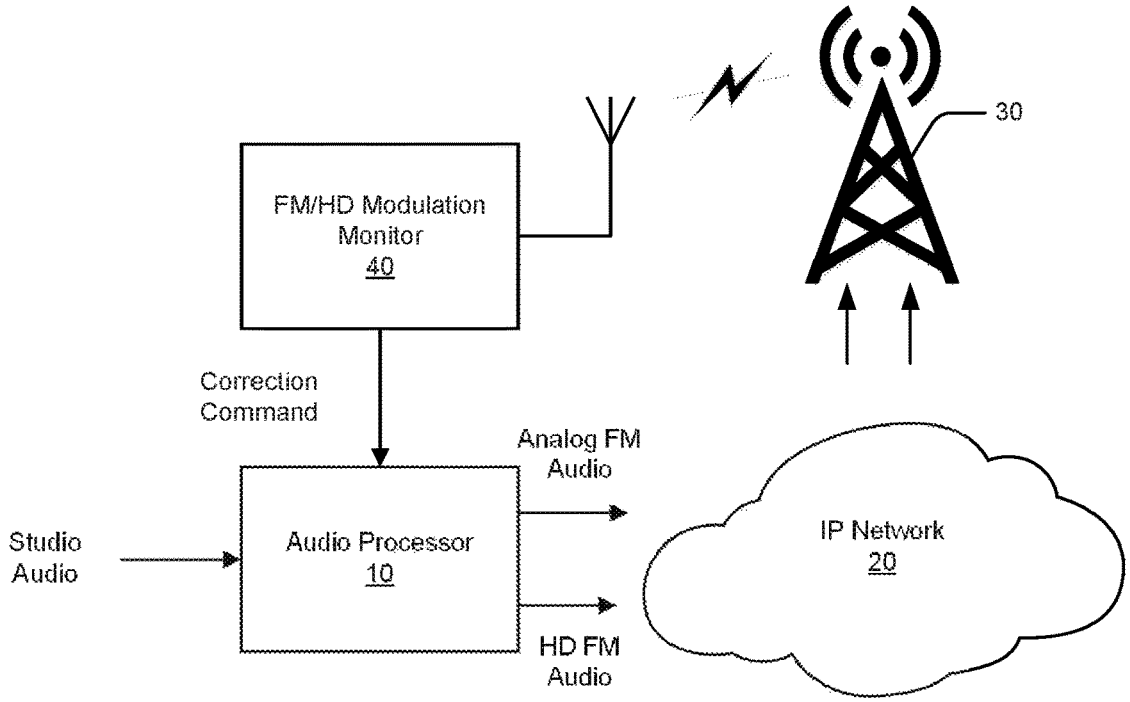
FIG. 2 Prior Art
FIG. 2 is a schematic diagram illustrating a conventional FM/HD modulation monitor for diversity delay error compensation in an FM/HD system.
Figure 3:
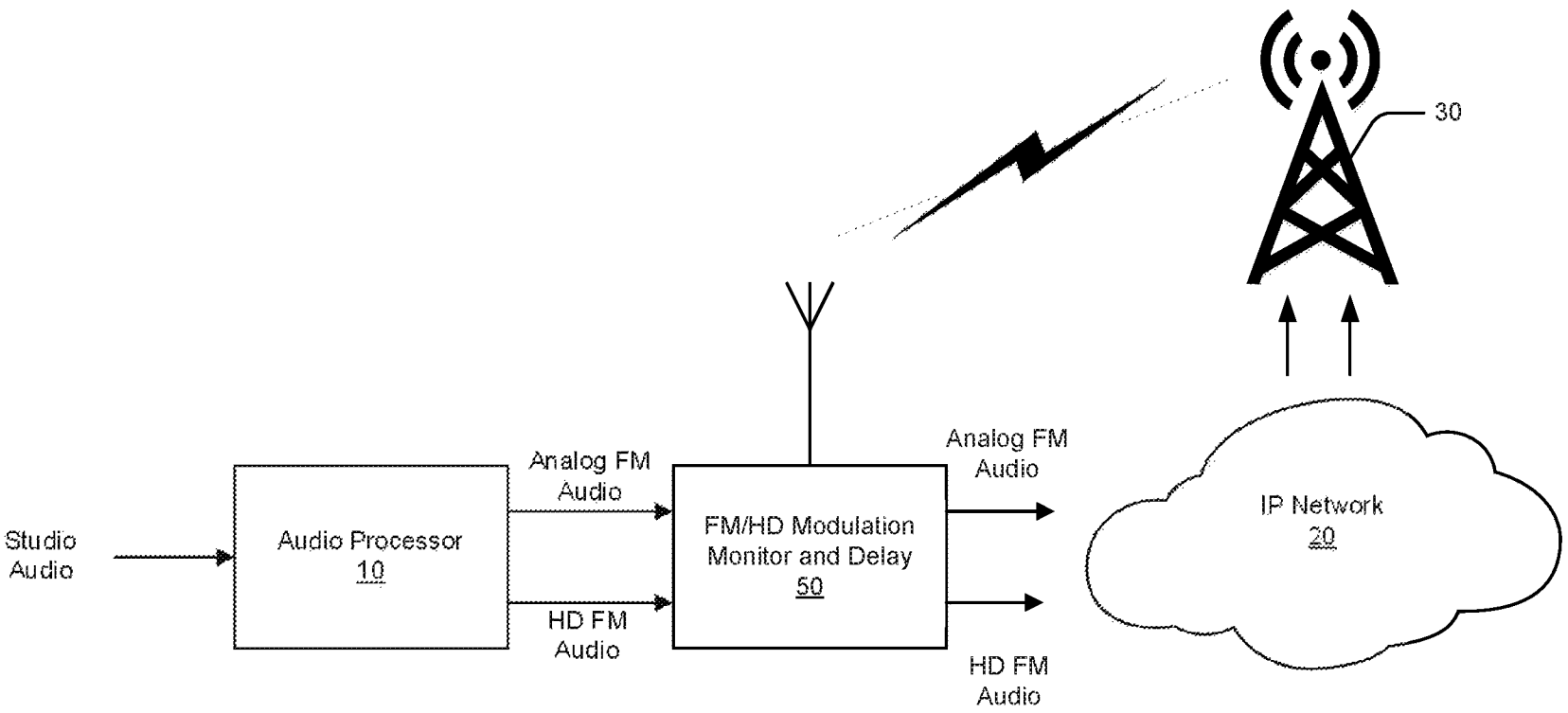
FIG. 3 Prior Art
FIG. 3 is a schematic diagram illustrating a conventional FM/HD modulation monitor and delay unit.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like items. It will be understood that when an item is referred to as being "connected" or "coupled" to another item, it can be directly connected or coupled to the other item or intervening items may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, items, and/or components, but do not preclude the presence or addition of one or more other features, integers, steps, operations, items, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Flowchart illustrations and/or block diagrams described herein may embody methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to one or more processors, such as one or more processors of a general purpose computer, special purpose computer or other device to implement methods and machines that perform the functions/acts specified in the flowchart and/or block diagram block or blocks. Such computer program instructions may also be stored in a non-transitory computer readable medium that constitutes an article of manufacture including instructions that, when executed on a computer, data processing apparatus, and/or other devices, implements the function/act specified in the flowchart and/or block diagram block or blocks.

Figure 4:
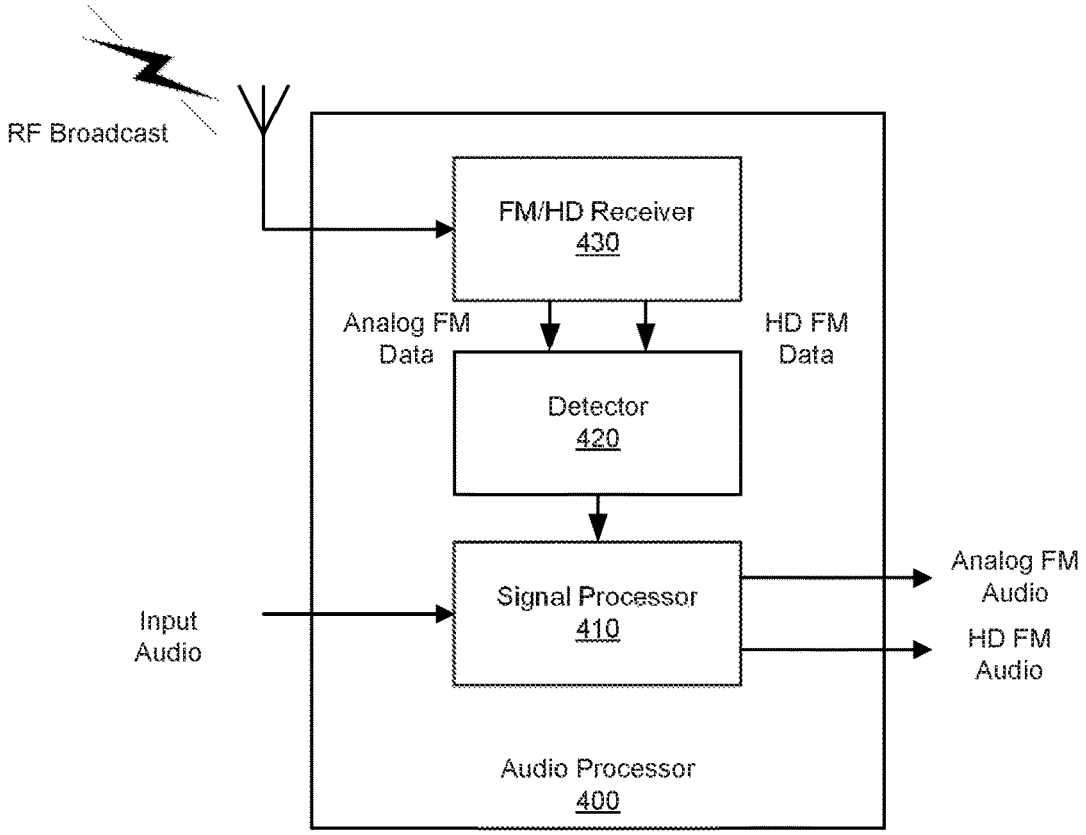
FIG. 4 is a schematic diagram illustrating an audio processor with integrated diversity delay error compensation according to some embodiments of the inventive subject matter.

FIG. 4 illustrates an audio processor 400 according to some embodiments of the inventive subject matter. The audio processor 400 includes a signal processor 410, which is configured to receive an input audio signal (e.g., a studio audio input) and to produce an analog FM audio signal and an HD FM audio signal therefrom. The analog FM audio signal and the HD FM audio signal may be provided, for example, to a remotely located FM transmitter via, for example, an IP network. As further shown, the audio processor 400 further includes an FM/HD receiver 430, which is configured to receive a radio frequency (RF) FM broadcast produced from the analog FM audio signal and the HD FM audio signal produced by the audio processor 400. The FM/HD receiver 430 produces analog FM data and HD FM data corresponding to respective analog FM and HD FM components of the received RF signal. The analog FM data and the HD FM data is provided to a detector 420, which is configured to correlate the analog FM data and the HD FM data and to determine a timing relationship of the analog FM data and the HD FM data responsive to the correlation. For example, as explained in detail below, the analog FM data and the HD FM data may be analog FM audio data and HD FM audio data, respectively, and the detector 420 may be configured to cross-correlate the analog FM audio data and the HD FM audio data to determine a time offset between the analog FM audio data and the HD FM audio data. Responsive to the correlation, the signal processor 410 may vary a timing relationship of the analog FM audio signal and an HD FM audio signal produced by the signal processor 410.

It will be appreciated that, in general, the components of the audio processor 400 may be implemented using analog circuitry, digital circuitry or a combination thereof. For example, the FM/HD receiver 430 may be implemented using one or more application-specific integrated circuits (ASICs) (e.g., a Silicon Labs Si4689 AM/FM/HD/DAB/DAB+ Radio Receiver integrated circuit) and accompanying peripheral circuitry. The detector 420 and the signal processor may be implemented using, for example, data processing circuitry, such as one or more microprocessors, microcontrollers or digital signal processor (DSP) chips, along with appropriate peripheral circuitry (e.g., memory chips, memory controllers and the like).

Figure 5:
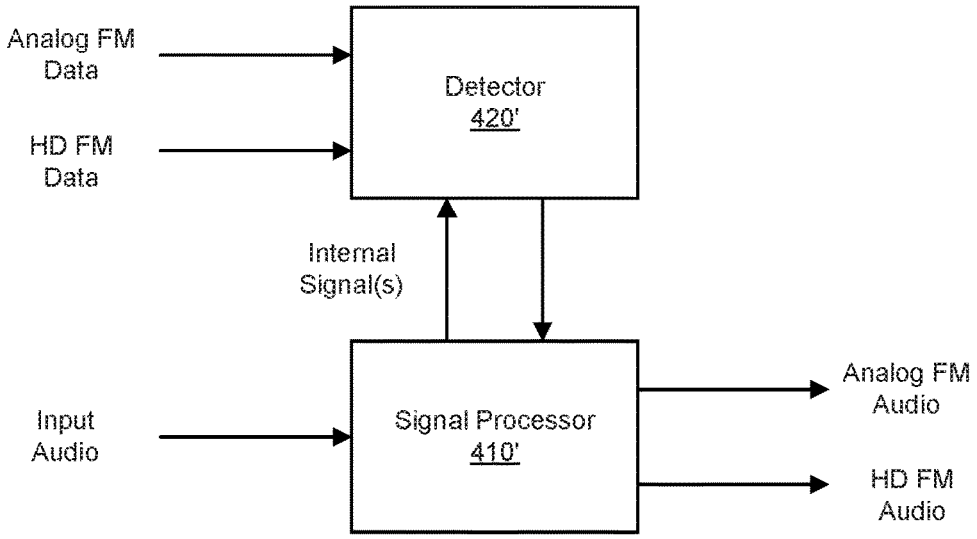
FIG. 5 is schematic diagram illustrating an audio processor according to further embodiments.

According to some embodiments, an audio processor such as that illustrated in FIG. 4 may take advantage of a priori knowledge of the transmitted signal. For example, as illustrated in FIG. 5, in some embodiments, a detector 420' may correlate the analog FM audio data and the HD FM audio data with pre-transmission audio data processed by a signal processor 410' and may determine a timing relationship of the analog FM and HD FM components from such a correlation.

Figure 6:
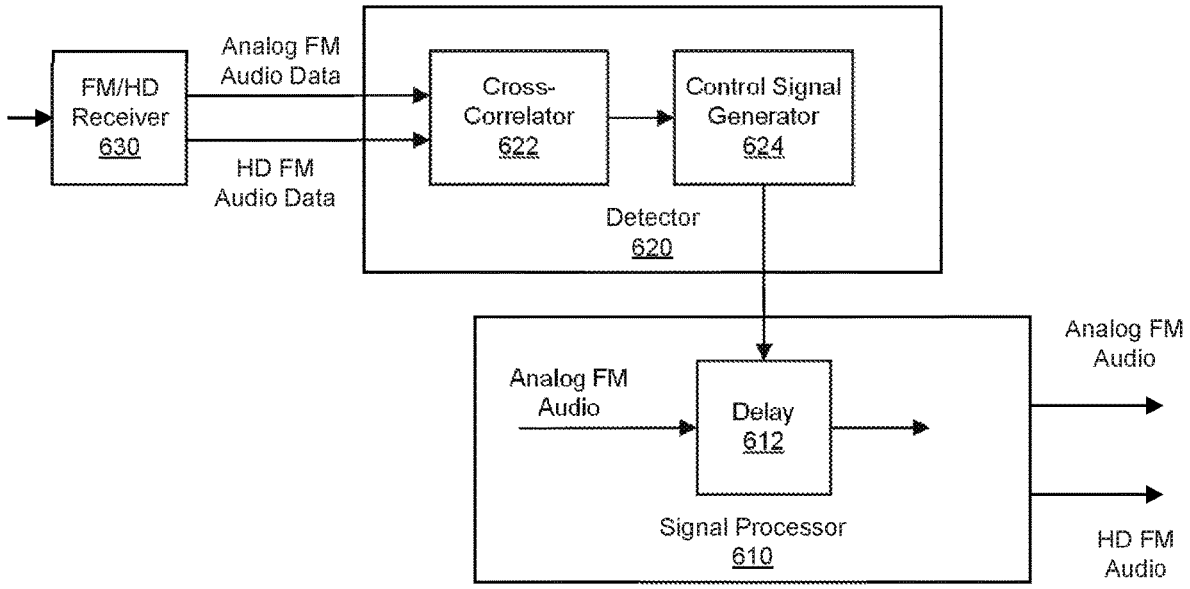
FIG. 6 is a schematic diagram illustrating an audio processer with a cross-correlation based diversity delay error detection arrangement according to some embodiments.

As noted above, according to some embodiments, a time offset between analog FM and HD FM components of a broadcast RF signal may be determined by cross-correlating audio data corresponding to the components. For example, as shown in FIG. 6, a detector 620 may receive analog FM audio data and HD FM audio data from an FM/HD receiver 630. The detector 620 includes a cross-correlator 622 that generates a cross-correlation of the analog FM audio data and HD FM audio data and a control signal generator 624 that generates a timing control signal responsive to the generated cross-correlation. For example, the timing control signal may be generated by detecting a peak in the cross-correlation and responsively generating a control signal that represents a desired delay to be applied by a delay unit 612 in an analog FM audio signal processing path of a signal processor 610 that generates the source analog FM audio and HD FM audio for the broadcast RF signal.

Figure 7:
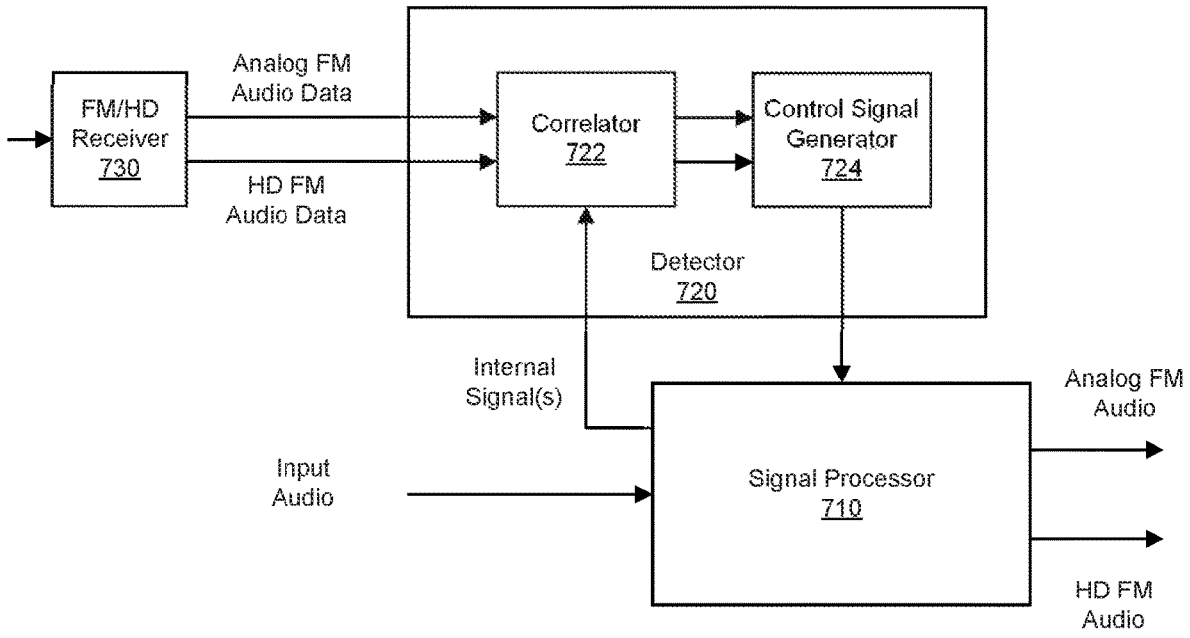
FIG. 7 is a schematic diagram illustrating an internal signal correlation based diversity delay error detection arrangement according to some embodiments.

According to further embodiments, such a time offset may also be determined by using correlations with known internal signals produced by a signal processor that produces a broadcast FM signal. Referring to FIG. 7, a detector 720 may receive analog FM audio data and HD FM audio data from an FM/HD receiver 730. The detector 720 includes a correlator 722 that generates correlations of the analog FM audio data and the HD FM audio data with one or more internal signals (e.g., a known audio data stream) processed by a signal processor 710. The detector 720 further includes a control signal generator 724 that generates a timing control signal responsive to the generated correlations. For example, the correlator 722 may generate respective correlations of the analog FM audio data and the HD FM audio data with analog FM and HD FM audio signals generated in the signal processor 710 that correspond to the same audio passage. The control signal generator 724 may generate the timing control signal by detecting peaks of the respective correlations and determining a time offset therebetween, and may apply the timing control signal to a delay unit in an analog FM audio signal processing path of the signal processor 710.

Figure 8:
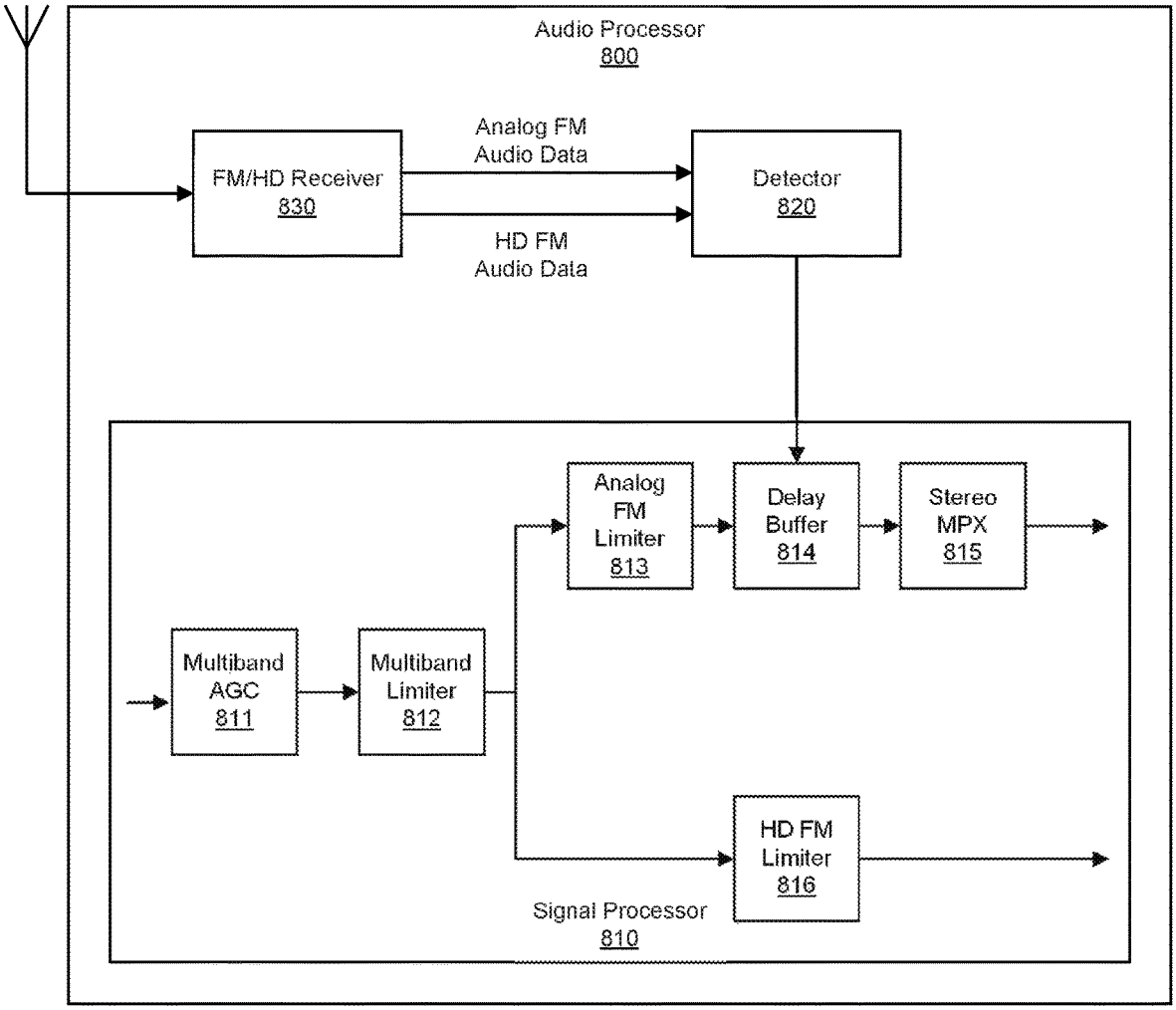
FIG. 8 is a schematic diagram illustrating an audio processor according to further embodiments.

According to further aspects, improved performance in diversity delay error compensation may be achieved by using an HD FM signal processing structure that can reduce deviation in audio data recovered from analog FM and HD FM components of a broadcast FM signal. Limiting such variation can allow for more reliable detection of the time offset between analog FM and HD FM components of a received broadcast signal. Referring to FIG. 8, an audio processor 800 according to some embodiments may include a signal processor 810 that includes a multiband automatic gain control (AGC) unit 811, which an audio input signal (e.g., studio audio or a derivative thereof) and applies variable gains to respective spectral components of the input audio signal, and a multiband limiter 812, which limits respective spectral components of the signal produced by the multiband AGC unit 811. A multiband limited audio signal produced by the multiband limiter 812 is then provided to separate analog FM and HD FM signal processors, which produce respective analog FM and HD FM audio signals for transmission. As illustrated, the analog FM processor may include an analog FM limiter 813, a delay buffer 814 and a stereo multiplex (MPX) generator 815, while the HD FM processor may include an HD FM limiter 816.

The delay buffer 814 is configured to delay the analog FM audio output responsive to a timing control signal generated by a detector 820 that cross-correlates analog FM audio data and HD FM audio data received from an FM/HD receiver 830. The particular structure of the signal processor 810 may aid in performing the cross correlation needed to control the delay buffer 814, as the audio content of the analog FM and HD FM components of the RF signal received by the FM/HD receiver 830 may be substantially similar due to the use of common processing through the multiband limiter 812. The signal processing elements in the respective analog FM and HD FM processing paths may introduce a relatively low level of variation between the audio content of the analog FM and HD FM components of the broadcast RF signal, thus potentially enhancing the potential of obtaining fast and accurate cross-correlation of the analog FM and digital FM audio data streams recovered from the broadcast RF signal. It will be understood, however, that embodiments of the inventive subject matter are not limited to the signal processing architecture illustrated in FIG. 8, and that some embodiments may include, for example, separate analog FM and HD FM signal processing paths that include, for example, respective chains of AGC units and multi-band limiters.

Figure 9:
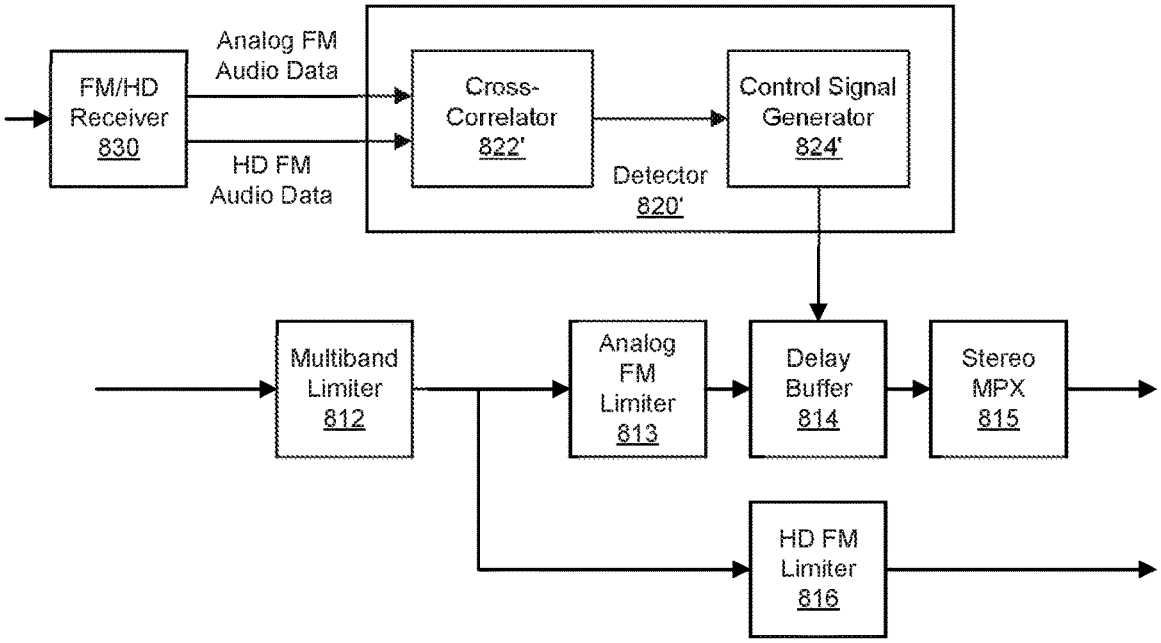
FIG. 9 is a schematic diagram illustrating a cross-correlation based diversity delay error detection arrangement for the audio processor of FIG. 8.

FIG. 9 illustrates an example implementation of a detector 820' that may be used in the architecture illustrated in FIG. 8. The detector 820' includes a cross-correlator 822' that generates a cross-correlation of the analog FM audio data with the HD FM audio data. A control signal generator 824' may detect a time offset between the analog FM audio data the HD FM audio data responsive to the cross-correlation (e.g., by detecting a peak in the cross-correlation) and responsively generate a control signal that controls the delay buffer 814 in the analog FM audio processing path. The cross-correlation could be performed, for example, at a periodic rate sufficient to provide a desired control bandwidth and response, and generation of the control signal might include, for example, averaging time offset measurements from cross-correlations performed over multiple intervals to provide damping of oscillations in the delay introduced by the delay buffer 814.

Figure 10:
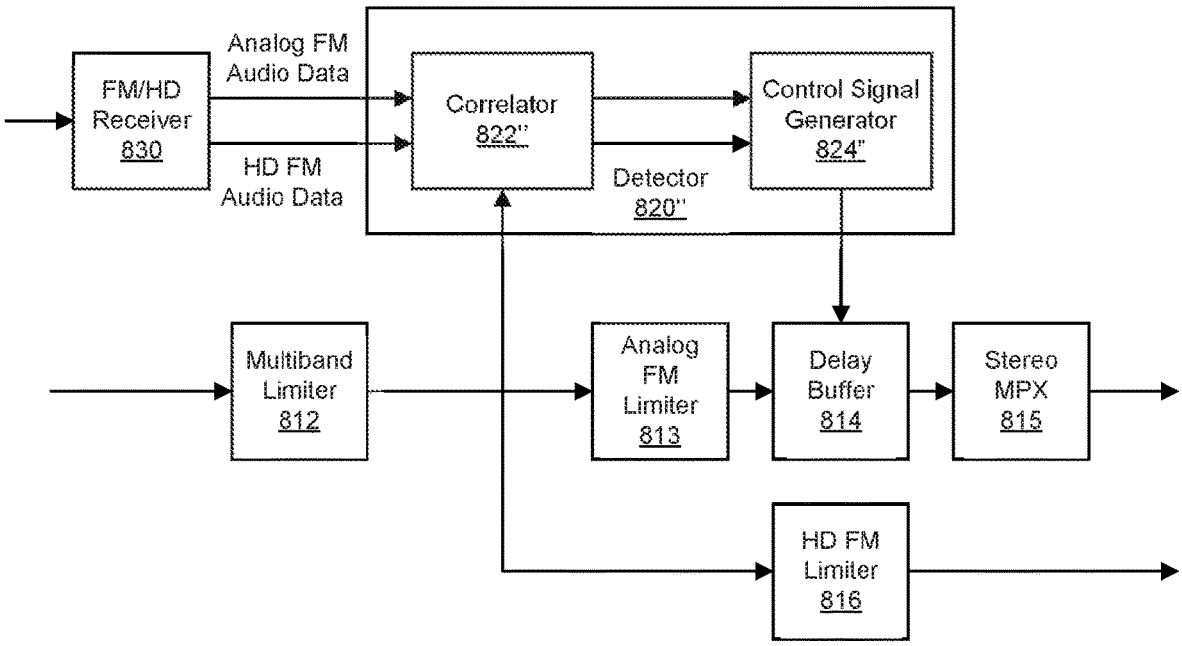
FIG. 10 is a schematic diagram illustrating an internal signal correlation based diversity delay error detection arrangement for the audio processor of FIG. 8.

FIG. 10 illustrates another approach wherein a detector 820" includes a correlator 822" that generates respective correlations of the analog FM and digital FM audio data streams with a known data sequence of the multi-band limited audio signal generated by the multiband limiter 812. The detector 820" further includes a control signal generator 824", which detects a time offset between the analog FM audio data and the HD FM audio data responsive to the correlations (e.g., by detecting an offset between peaks in the correlations) and responsively generates a control signal that controls the delay buffer 814 in the analog FM audio processing path. The known sequence of the multi-band limited audio may be, for example, a passage selected by the signal processor based on audio signal characteristics that facilitates correlation and detection, such as a passage with a distinctive audio feature that is relatively unobscured by noise. Such a passage may be identified, for example, by detecting an audio passage that meets a threshold criterion that can support more accurate detection in the received RF signal, such as minimum signal-to-noise ratio, autocorrelation characteristic or the like. It will be further appreciated that the known signal used for correlations with the received analog FM and HD FM signals may be signals other than that produced by a multiband limiter 812, such as audio signals from the respective analog FM and HD FM processing branches of the signal processor 810.

Figure 11:
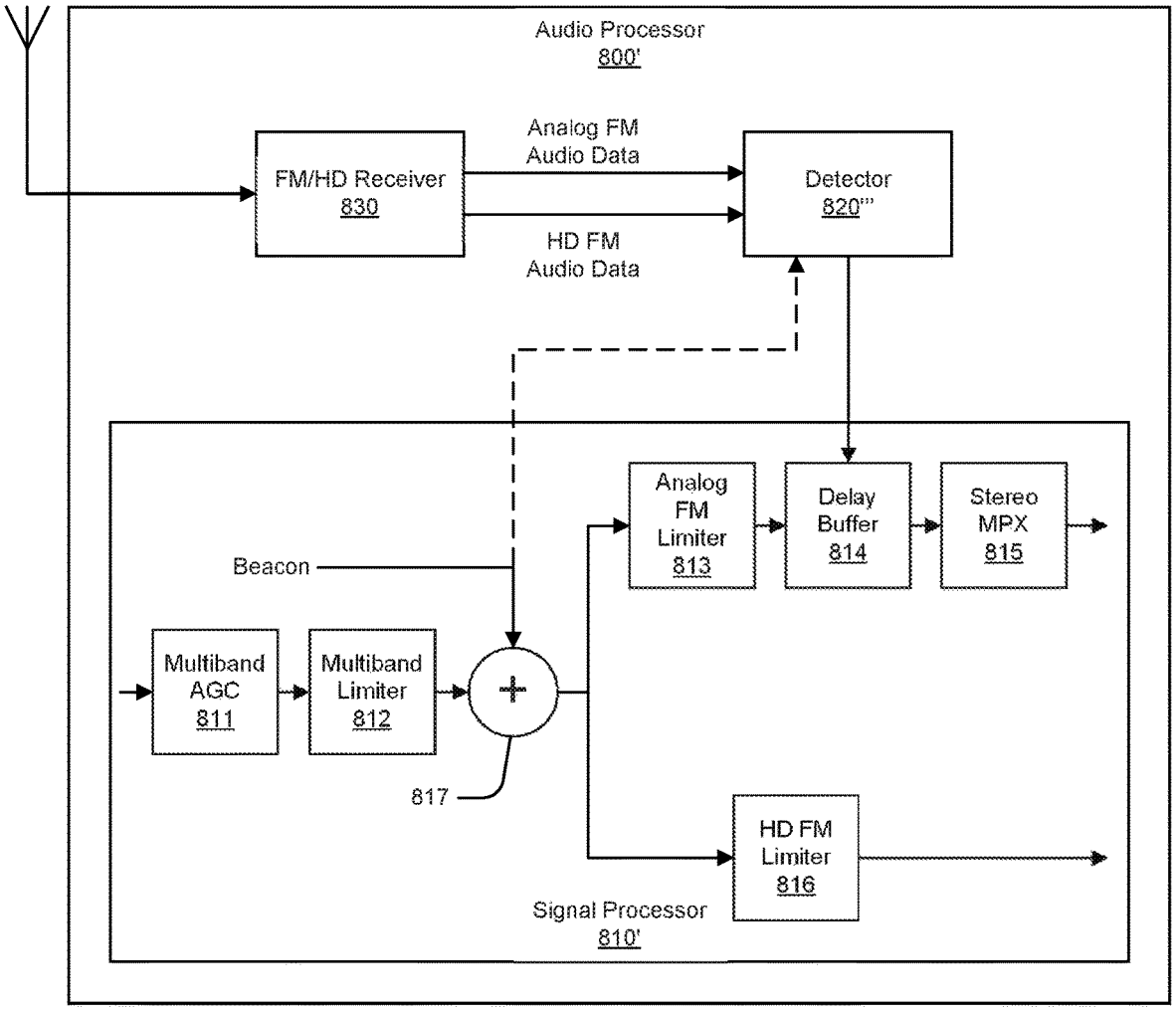
FIG. 11 is a schematic diagram illustrating a beacon-based diversity delay error detection arrangement for the audio processor of FIG. 8.

According to further embodiments, use of known pre-transmission information may include transmission of an explicit in-band beacon signal that may be more reliably detected. Referring to FIG. 11, an audio processor 800' may include a signal processor 810' that includes a multiband AGC unit 811, a multiband limiter 812, an analog FM processor including an analog FM limiter 813, a delay buffer 814 and a stereo multiplex (MPX) generator 815, and an HD FM processor including an HD FM limiter 816, as described above with reference to FIG. 8. The signal processor 810' further includes beacon injection unit 817 that is configured to inject a beacon signal in the common analog/HD audio signal path, such that the beacon is included in both the transmitted analog FM signal and the transmitted HD FM signal. The beacon signal may be, for example, a signal injected into the audio band at frequencies that may not be perceptible to a listener. A detector 820' is configured to determine a time offset between analog FM audio data and HD FM audio data produced by an FM/HD receiver 830 based on the beacon. For example, the analog FM audio data and the HD FM audio data may be individually correlated with the beacon to determine the time offset, along the lines described above with reference to FIG. 10. Such a beacon may also be used to improve a cross-correlation based detection approach along the lines described above with reference to FIG. 9. For example, if the beacon is a relatively high frequency audio signal, the analog FM and HD FM audio data streams produced by the FM/HD receiver 830 could be high-pass filtered to remove most of the low-frequency audio content of these streams before cross-correlation to detect the offset of the beacon components of the audio data streams.

It will be further appreciated that a beacon signal along the lines described above with reference to FIG. 11 could also be used by a receiver (e.g., a car radio or other user receiver) to perform diversity delay error compensation on its own audio output. For example, such a receiver could perform correlations as described above to determine a time offset between analog FM and HD FM audio data streams. The determined offset may be used, for example, to appropriately delay generation of audio from the analog FM audio to reduce or eliminate undesirable audio effects when the receiver switches between the HD and analog streams.

In the drawings and specification, there have been disclosed exemplary embodiments of the inventive subject matter. Although specific terms are employed, they are used in a generic and descriptive sense only and not for purposes of limitation, the scope of the inventive subject matter being defined by the following claims.

That which is claimed:

1. An audio processor comprising:

an FM/HD receiver configured to receive a broadcast RF signal that corresponds to a first input audio signal previously processed by the audio processor;

a detector configured to determine a correlation of first and second data corresponding to an analog FM component and an HD FM component, respectively, of the broadcast RF signal that corresponds to the first input audio signal previously processed by the audio processor; and a signal processor configured to generate an analog FM audio signal and an HD FM audio signal responsive to a pre-broadcast input audio signal and to control a relative timing of the generated analog FM audio signal and the HD FM audio signal based on the determined correlation, wherein the audio processor is configured to provide the generated analog FM audio signal and the HD FM audio signal to a digital communications network for transmission to a broadcast RF transmitter, and wherein the FM/HD receiver, detector, and signal processor comprise a set of circuits all integrated within the audio processor.

2. The audio processor of claim 1:

wherein the detector is configured to generate a timing control signal responsive to the determined correlation; and wherein the signal processor is configured to delay the analog FM audio signal with respect to the HD FM audio signal responsive to the timing control signal.

3. The audio processor of claim 2, wherein the signal processor comprises:

a multiband limiter configured to generate a multiband limited audio signal responsive to the second input audio signal;

an HD FM audio processor configured to generate the HD FM audio signal responsive to the multiband limited audio signal; and an analog FM audio processor configured to generate the analog FM audio signal responsive to the multiband limited audio signal and to delay the analog FM audio signal responsive to the timing control signal.

4. The audio processor of claim 3, wherein the detector is configured to receive an internal signal generated by the signal processor and to generate the timing control signal responsive to the internal signal.

5. The audio processor of claim 3, wherein the signal processor is configured to add a beacon to the multiband limited signal and wherein the detector is configured to detect first and second beacon components corresponding to the added beacon in the first and second data, respectively, and to generate the timing control signal responsive to the detected beacon components, wherein the beacon comprises information that is not present in the input audio signal.

6. The audio processor of claim 2, wherein the detector is configured to generate the timing control signal responsive to an internal signal produced by the signal processor.

7. The audio processor of claim 2, wherein the detector is configured to generate a cross-correlation of the first and second data and to generate the timing control signal responsive to the generated cross-correlation.

8. The audio processor of claim 2, wherein the detector is configured to generate respective correlations of the first and second data with known data generated by the signal processor and to generate the timing control signal from the generated correlations.

9. The audio processor of claim 1, wherein the detector is further configured to generate a timing control signal from the first and second audio data streams corresponding to respective ones of the analog FM component and the HD FM component of the broadcast RF signal; and wherein the signal processor comprises:

a multiband limiter configured to generate a multiband limited audio signal responsive to the pre-broadcast input audio signal;

an HD FM audio signal processor configured to generate the HD FM audio signal responsive to the multiband limited audio signal; and an analog FM audio signal processor configured to generate the analog FM audio signal responsive to the multiband limited audio signal and to delay the analog FM audio signal responsive to the timing control signal.

10. The apparatus of claim 9, wherein the detector is configured to receive an internal signal generated by the signal processor and to generate the timing control signal responsive to the internal signal.

11. The apparatus of claim 9, wherein the signal processor further comprises a beacon signal insertion unit configured to add a beacon to the multiband limited audio signal, the beacon comprising information that is not present in the pre-broadcast input audio signal, and wherein the detector is configured to detect beacon components corresponding to the beacon in the first and second audio data streams and to generate the timing control signal responsive to the detected beacon components.

12. The apparatus of claim 9, wherein the detector is configured to generate a cross-correlation of the first and second audio data streams and to generate the timing control signal responsive to the generated cross-correlation.

13. The apparatus of claim 9, wherein the detector is configured to generate respective correlations of the first and second audio data streams with known data generated by the signal processor and to generate the timing control signal from the generated correlations.

14. A method comprising:

at an audio processor, determining a correlation of first and second data corresponding to an analog FM component and an HD FM component, respectively, of a broadcast RF signal that corresponds to a first input audio signal previously processed by the audio processor;

operating the audio processor to generate an analog FM audio signal and an HD FM audio signal from a pre-broadcast input audio signal and to vary a relative timing of the generated analog FM audio signal and the HD FM audio signal based on the determined correlation; and providing the generated analog FM audio signal and the HD FM audio signal to a digital communications network for transmission to a broadcast RF transmitter, wherein the audio processor comprises an FM/HD receiver, a detector, and a signal processor integrated as a set of circuits therein.

15. The method of claim 14:

wherein operating the audio processor to generate the analog FM audio signal and the HD FM audio signal from the pre-broadcast input audio signal and to vary the relative timing of the generated analog FM audio signal and the HD FM audio signal based on the determined correlation comprises:

generating a multiband limited audio signal responsive to the pre-broadcast input audio signal;

generating an HD FM audio signal responsive to the multiband limited audio signal;

generating an analog FM audio signal responsive to the multiband limited audio signal;

generating a timing control signal from first and second audio data streams corresponding to respective ones of the analog FM audio and HD FM audio components of the broadcast RF signal; and delaying the generated analog FM audio signal responsive to the timing control signal.

16. The method of claim 15, further comprising adding a beacon to the multiband limited audio signal, the beacon comprising information that is not present in the pre-broadcast input audio signal, and wherein generating the timing control signal comprises detecting beacon components corresponding to the beacon in the first and second audio data streams and generating the timing control signal responsive to the detected beacon components.

17. The method of claim 15, wherein generating the timing control signal comprises generating the timing control signal responsive to information in the analog FM audio signal and the HD FM audio signal received outside of an RF transmission path of the RF signal.

18. The method of claim 15, wherein generating the timing control signal comprises generating a cross-correlation of the first and second audio data streams and generating the timing control signal responsive to the generated cross-correlation.

19. The method of claim 14, wherein determining the correlation is preceded by:

receiving the broadcast RF signal at the audio processor; and generating the first and second data from the received RF signal.

20. A computer program product comprising a non-transitory computer-readable medium having computer program instructions stored therein that, when executed on a processor of the audio processor, causes the audio processor to perform the method of claim 14.

21. An integrated system for diversity delay error compensation in a transmitter, comprising:

a. an FM/HD receiver, wherein the FM/HD receiver is configured to receive a radio frequency (RF) FM broadcast produced from an analog FM audio signal and an HD audio signal previously produced by the system, and wherein the FM/HD receiver is further configured to produce analog FM data and HD FM data corresponding to respective analog FM and HD FM components of the received RF FM broadcast;

b. a detector, wherein the detector is configured to directly receive the analog FM data and HD FM data from the FM/HD receiver, and wherein the detector is further configured to correlate the analog FM data and HD FM data and to determine a timing relationship of the analog FM data and the HD FM data responsive to the correlation; and c. a signal processor, wherein the signal processor is configured to receive a pre-broadcast input audio signal, and wherein the signal processor is further configured to generate an analog FM audio signal and an HD FM audio signal responsive to the received pre-broadcast input audio signal and to control a relative timing of the generated analog FM audio signal and HD FM audio signal based on the determined timing relationship of the analog FM data and the HD FM generated from the received RF FM broadcast; and wherein the system is configured to provide the generated analog FM audio signal and the HD FM audio signal to a digital communications network for transmission to a broadcast RF transmitter, and wherein the FM/HD receiver, detector, and signal processor comprise a set of circuits all integrated within an audio processor.

* * * * *